United States Patent [19]

Mennuto

[11] 4,091,593

[45] May 30, 1978

[54] PANEL ASSEMBLY INCLUDING SIDE CAPS AND PANEL RETAINING MEANS ASSOCIATED THEREWITH

[76] Inventor: Anthony R. Mennuto, 769 Pascack Rd., Paramus, N.J. 07652

[21] Appl. No.: 763,245

[22] Filed: Jan. 28, 1977

[51] Int. Cl.[2] ..... E04C 2/36

[52] U.S. Cl. ..... 52/620; 52/627

[58] Field of Search ..... 52/716, 717, 456, 620, 52/624, 627, 623, 628, 470; 160/90, 91, 232; 49/501; 24/81 CC; 285/DIG. 2; 138/89; 220/243, 314, 315, 324, 325, 327, 328

[56] References Cited

U.S. PATENT DOCUMENTS

| | | | |
|---|---|---|---|
| 1,047,727 | 12/1912 | Anschutz | 285/DIG. 2 |
| 2,218,581 | 10/1940 | Levan | 138/89 |
| 2,633,946 | 4/1953 | Huizenga | 52/620 |
| 2,654,620 | 10/1953 | Tinnerman | 138/89 |
| 3,550,635 | 12/1970 | Schroer | 138/89 |

FOREIGN PATENT DOCUMENTS

| | | | |
|---|---|---|---|
| 131,818 | 2/1933 | Austria | 138/89 |

*Primary Examiner*—John E. Murtagh
*Attorney, Agent, or Firm*—Anthony F. Cuoco

[57] ABSTRACT

A panel assembly of the type having a pair of panels arranged in spaced relation to each other includes longitudinally extending side caps and means associated therewith for retaining the panels in the side caps. The panels are fabricated to a standard size and trimmed to a required utilization size, with the side caps and retaining means imparting a finishing and strengthening affect to the panel assembly.

13 Claims, 10 Drawing Figures

PANEL ASSEMBLY INCLUDING SIDE CAPS AND PANEL RETAINING MEANS ASSOCIATED THEREWITH

BACKGROUND OF THE INVENTION

1. Field of the Invention

This invention relates generally to panel assemblies such as may be used for a variety of purposes. More particularly, this invention relates to panel assemblies of the type described including a pair of panels in spaced relation to each other, and side caps arranged in combination with means for retaining the panels in the side caps. Still, more particularly, this invention relates to the combination described, whereby the panels may be fabricated to a standard size and customized to a required utilization size. The side caps and retaining means cooperate to maintain the panels in spaced relation while providing a finishing and strengthening affect to the panel assembly so customized.

2. Description of the Prior Art

Panel assemblies with which the invention can be advantageously used may be of the type including a core sandwiched between a pair of one piece panels whereby the panels are in spaced relation to each other. By way of illustration, but not by way of limitation, these assemblies may form a door as described in U.S. Pat. No. 3,599,703, issued on Aug. 17, 1971 to Anthony R. Mennuto and Nicholas Popovich and assigned to said Anthony R. Mennuto. Prior to the present invention the panels had to be fabricated to various widths to accommodate various utilization requirements. The present invention permits panels for this use, and for other uses contemplated by the invention to be fabricated to a standard size and then trimmed to size to suit a particular utilization requirement. The combined side cap and retaining means of the invention serves the dual purpose of retaining the trimmed panels so as to provide a strengthened panel assembly and to further provide a capping and finishing effect irrespective of the ultimate size of the finished panel assembly.

Although, for purposes of illustration, the invention will be described with reference to a door assembly as aforenoted, it will be understood that the structural arrangement disclosed is suitable for any similar type panel assembly, or indeed for any purpose requiring the structural features disclosed, as will be understood by those skilled in the art.

SUMMARY OF THE INVENTION

This invention contemplates a panel assembly of the type including a pair of panels arranged in spaced relation to each other. Longitudinally extending side caps are disposed along opposite sides of the panels and receive the panel edges, and which edges have been trimmed to provide panels of a desired size. With the panel edges so received in the side caps, a plurality of retainers including resilient members are arranged along the length of the side caps. The resilient retainer members cooperate with the side caps so that when a force is applied to the members, such as by screw thread means or the like, the members abut the panels and thereby retain the panels in the side caps. The side caps are configured to provide a finished appearance to the trimmed panel assembly as well as to strengthen the assembly. Several embodiments of the invention are disclosed which illustrate variously configured retainers and side caps as may be required for a particular application.

The main object of this invention is to provide an assembly of the type including a pair of panels in spaced relation to each other, and which panels may be fabricated to a predetermined size and then trimmed to a required utilization size. Combined side cap and retaining means are provided for retaining the panels in said spaced relation and for providing a finishing and strengthening affect to the panel assembly.

Another object of this invention is to provide means for providing a finished panel assembly of the type described irrespective of the required utilization size or configuration of the assembly.

Another object of this invention is to enable fabrication of the panels to a standardized size, and which panels can be easily adapted to a required utilization size, and thereafter incorporated into a customized assembly according to the invention.

These and other objects and features of the invention will become more apparent from the following description thereof with reference to the accompanying drawings.

DESCRIPTION OF THE INVENTION

Figure 1:
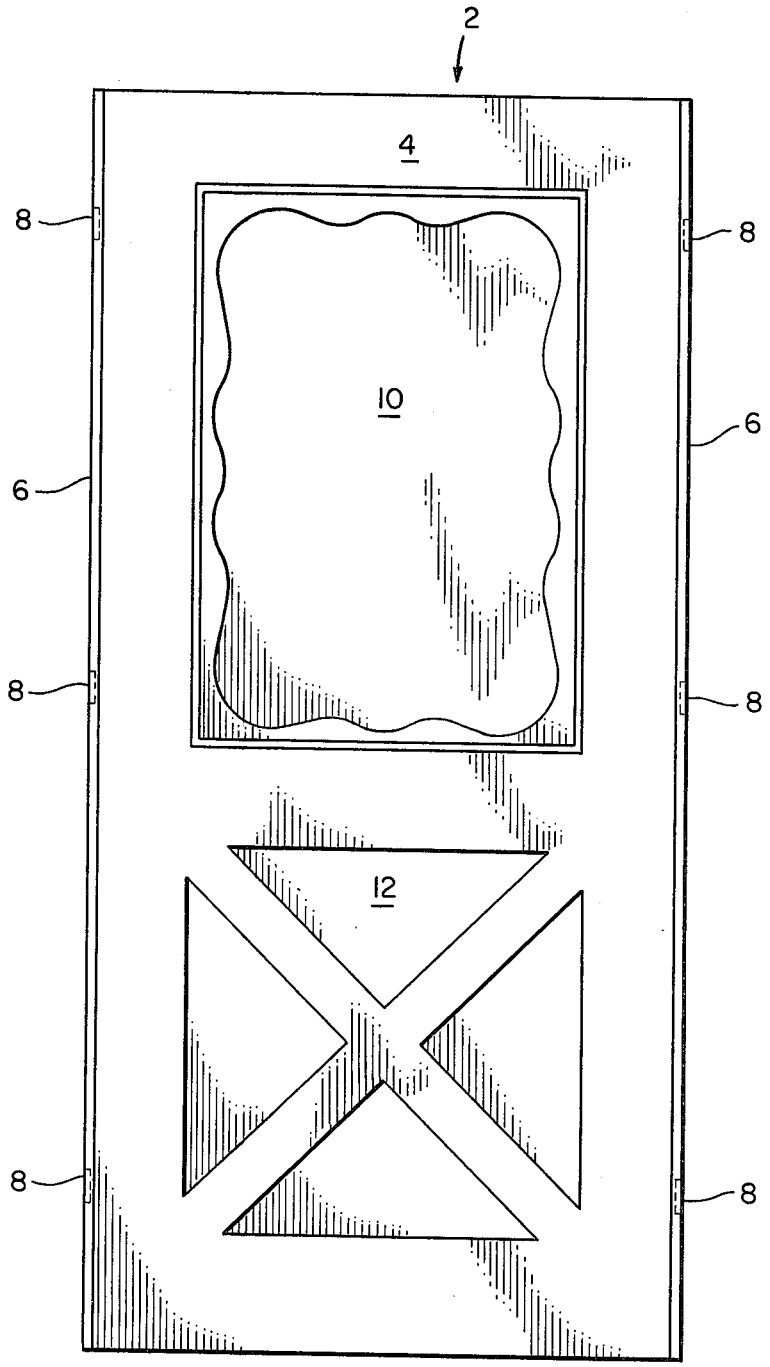
FIG. 1 is a front plan view of a panel assembly, which forms a door, and illustrates generally the side cap and retaining means of the invention as described herein.

With reference first to FIG. 1, there is shown a door assembly illustrated generally by the numeral 2. Door assembly 2 includes a one piece front panel 4 and a corresponding one piece rear panel (not shown) disposed in spaced relation behind front panel 4, and which panels may be separated by a core or the like such as illustrated in the aforenoted U.S. Pat. No. 3,599,703.

Door assembly 2 carries on its opposite sides longitudinally extending side caps designated by the numeral 6. Side caps 6 are identical in configuration and each carry a plurality of retainers according to the invention and designated by the numeral 8 in the figure. Each of the side caps 6 is shown as carrying three retainers 8, one of which is disposed near the top of the side cap, another being disposed near the center and the third being disposed near the bottom of the side cap. It will be understood that as many retainers as are necessary in accordance with the length of the panels may be used as required for a particular application.

Front panel 4 and its corresponding rear panel, which may be one piece metal stampings or the like, are fabricated to a predetermined oversized width, with the intention being that the panels be trimmed to a particular utilization width. Side caps 6 are thereafter assembled as will be hereinafter described to provide a finished rigid panel assembly. As shown in FIG. 1, each side of the panel assembly includes a side cap 6 which implies that each side of the panels are trimmed. This is a usual situation to maintain a symmetrical disposition of an opening 10 and a decorative embossed or affixed member 12 associated with the door assembly. It will be understood however, that in some applications only one side of the panel need be trimmed, although both sides will carry a side cap 6 with its associated fastening means 8.

Figure 2:
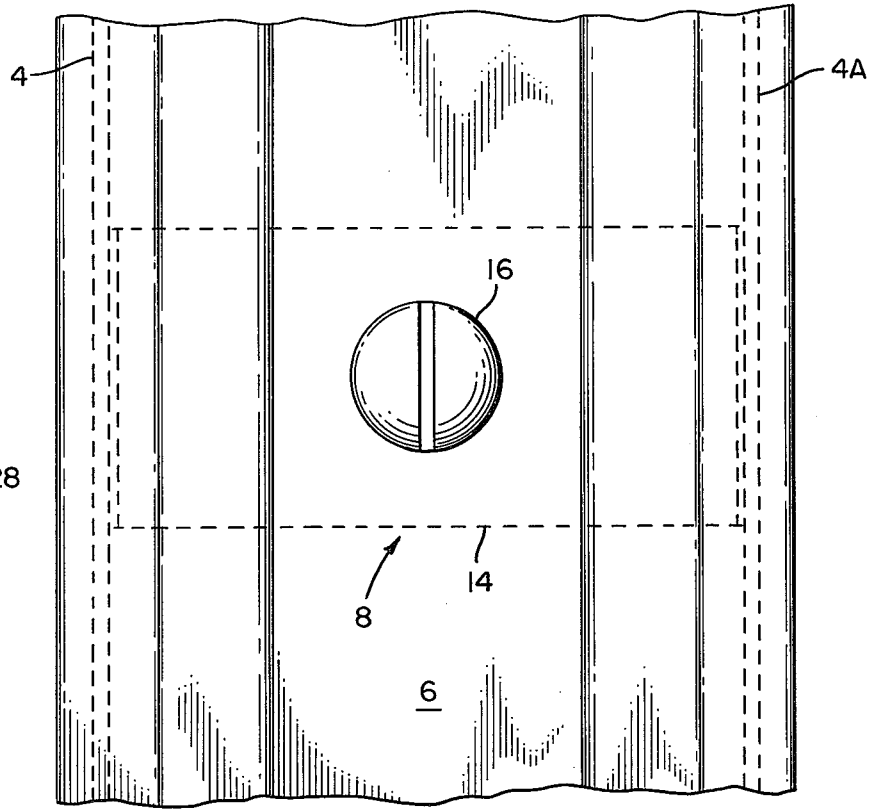
FIG. 2 is a partial right end view, relative to FIG. 1, and more particularly illustrating the side cap and retaining means shown generally in FIG. 1.

With reference to FIG. 2, a side cap 6 is shown in structural relationship with front panel 4 and the aforenoted rear panel designated by the numeral 4A, said panels being in spaced relation to each other as heretofore noted. The panels are retained in side cap 6 by retainers 8, one of which is shown, and which retainers include a resilient clip 14 and an adjusting screw 16.

The particular configurations of retainer 8 and side cap 6 in accordance with the several embodiments of the invention will be next described with reference to FIGS. 3 through 10.

Figure 3:
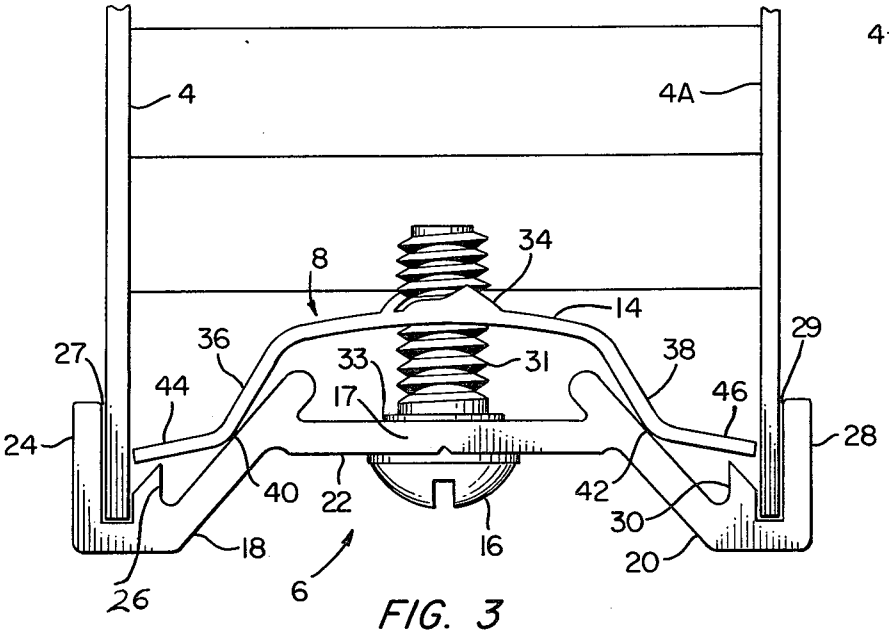
FIG. 3 is a diagrammatic top view showing one embodiment of the side cap and panel retaining means of the invention.

With reference first to FIG. 3, an embodiment of the invention is shown wherein side cap 6, which may be a rigid or semi-rigid extrusion or otherwise formed member of a suitable metallic material, includes an inwardly extending generally wedge shaped portion 17 having a pair of sloping sides 18 and 20 separated by a base 22.

Side 18 terminates in laterally extending members 24 and 26 which form a channel or slot 27 for receiving an edge of panel 4, while side 20 terminates in laterally extending members 28 and 30 which form a channel or slot 29 for receiving a corresponding edge of panel 4A.

Retainer 8 includes resilient clip 14. Screw 16, shown as a round head sheet metal screw, has its threaded shank portion 31 extending through a clearance hole 33 in base 22 of wedge shaped portion 17 and in screw thread engagement with a thickened portion 34 of clip 14. Clip 14 is substantially U-shaped, having sides 36 and 38 thereof supported by sloping sides 18 and 20 of wedge shaped portion 17 at points 40 and 42 thereof, and members 44 and 46 extending angularly from sides 36 and 38 and terminating substantially normal to and near panels 4 and 4A, respectively. As screw 16 is turned by conventional means such as a screwdriver or the like to extend through resilient clip 14, which may be a suitable spring type metallic material. Clip 14 spreads whereby ends 36 and 38 slide along sides 18 and 20 of wedge shaped portion 17 and members 44 and 46 are displaced to abut the edges of panels 4 and 4A, respectively, so as to retain the panels in slots 27 and 29 against members 24 and 28. In this respect clip 14 is a retainer for retaining the panels in the slots upon screw 16 being so turned.

Figure 4:
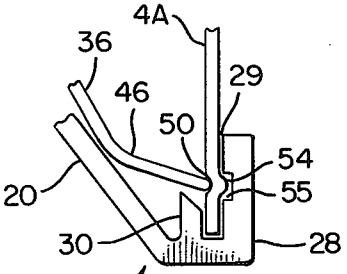
FIG. 4 is a diagrammatic partial top view illustrating a modification of the side cap and panels shown in FIG. 3 for improved panel retaining characteristics.

FIG. 4 shows a modification of the embodiment of the invention illustrated in FIG. 3. Thus, an edge of panel 4A, which is shown for purposes of illustration, is disposed in slot 29. An area of said edge retained in the aforenoted slot has on the inside surface thereof a dimple 50 which receives the end of member 46 when screw 16 is turned as aforenoted. The outside surface of panel 4A carries a corresponding node 54 which is likewise received in a recess 55 in member 28. The arrangement described with reference to FIG. 4 enhances the retention of the edges of panels 4 or 4A, as the case may be, in the respective slots as will now be understood by those skilled in the art.

Figure 5:
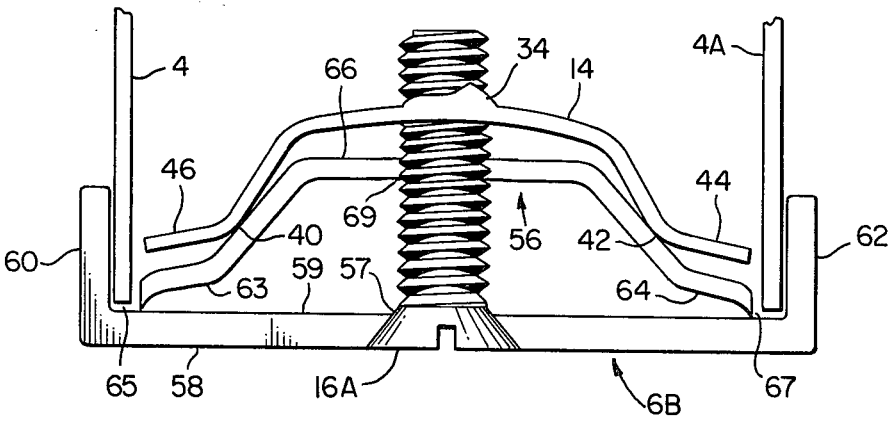
FIG. 5 is a diagrammatic top view illustrating another embodiment of the invention and particularly showing a two piece retaining means and a simplified side cap as may thereupon be used.

With reference now to FIG. 5, there is shown an embodiment of the invention which features a simplified side cap designated by the numeral 6B. Side cap 6B is used in conjunction with a two piece retainer including resilient clip 14, substantially as described with reference to FIG. 3, and a wedge member designated by the numeral 56.

To this end, side cap 6B is substantially U-shaped in cross-section having a base member 58 separating a pair of side members 60 and 62. Wedge 56 is disposed so that it is supported by the inside surface 59 of base member 58 of side cap 6B. The arrangement is such that the wedge has members 63 and 64 extending angularly from a top member 66 and terminating near side cap ends 60 and 62, respectively, so as to provide sufficient clearance or slots 65 and 67 for receiving the edges of panels 4 and 4A therein.

A flat head sheet metal screw 16A disposed in a countersunk hole 57 carried by bottom member 58 of side cap 6B extends through a clearance hole 69 centrally disposed in top member 66 of wedge 56, and engages clip 14 in screw thread relation as heretofore described with reference to FIG. 3. As screw 16A is turned to extend through clip 14, the clip spreads so that end 44 thereof abuts the edge of panel 4A and end 46 abuts the edge of panel 4 to retain the edges against side cap ends 60 and 62.

In this connection it is noted that wedge 56 serves the same purpose as wedge shaped portion 17 of side cap 6 shown in FIG. 3. That is, points 40 and 42 of the clip rest on end members 63 and 64 of the wedge, which is a rigid member, as they do on members 18 and 20 of wedge shaped portion 17. The embodiment of the invention of FIG. 5 has the obvious advantage of providing a simplified side cap construction as will be readily seen by those skilled in the art. The configuration shown in FIG. 4 may also be applied to the embodiment of the invention shown in FIG. 5 for enhanced retention characteristics as will also be understood by those skilled in the art.

The embodiment of the invention shown in FIGS. 6 and 7 feature a two piece retainer including resilient clip 14 and a wedge and side cap similar to those described with reference to FIG. 5. However, to increase the panel retaining characteristics as may be desirable for some applications, the wedge and side cap have been modified as will be next described.

Figure 6:
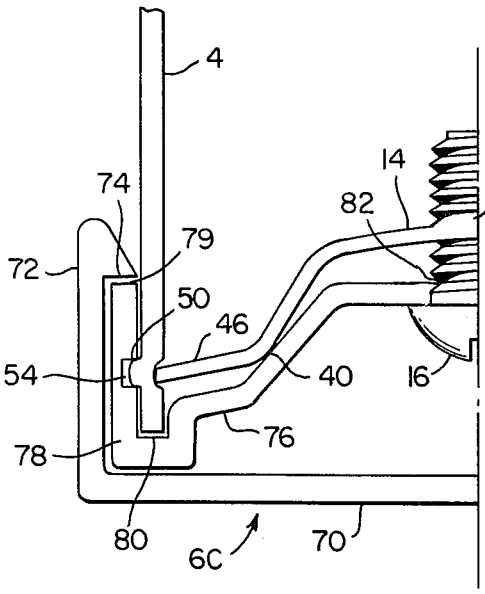
FIG. 6 is a diagrammatic left half top view showing another embodiment of the invention whereby the two piece retaining means shown in FIG. 5 and the panels retained thereby are modified for increased retention of the panels in the side caps.

With reference first to FIG. 6, a side cap 6C is shown which, as side cap 6B is substantially U-shaped in cross-section. For purposes of illustration, only the left side of the assembly is shown and described. It will be understood that the right side of the assembly is of like configuration.

Thus, side cap 6C includes a base 70 and an extending side member 72 terminating in a ledge 74. A wedge 76 which supports clip 14 has an extending end member 78 which forms groove 80 for receiving the edge of panel 4. In this respect wedge 76 has a function similar to wedge shaped portion 17 of the side cap structure described and illustrated with reference to FIG. 3 and to the structure of wedge 56 described and illustrated with reference to FIG. 5.

Wedge 76 has a clearance hole 82 through which round head screw 16 passes so as to be in screw thread engagement with clip 14, whereupon turning of the screw spreads clip 14 so that end 46 of the clip abuts panel 4 to retain the panel in slot 80, after which side cap 6C is snapped over the clip, wedge and panel assembly, and retained thereon by ledge 74 being adjacent end 79 of member 78. For still further increasing the panel retaining characteristics, the features described with reference to FIG. 4 may be incorporated into the invention as shown in FIG. 6, wherein like elements carry like numerical designations.

Figure 7:
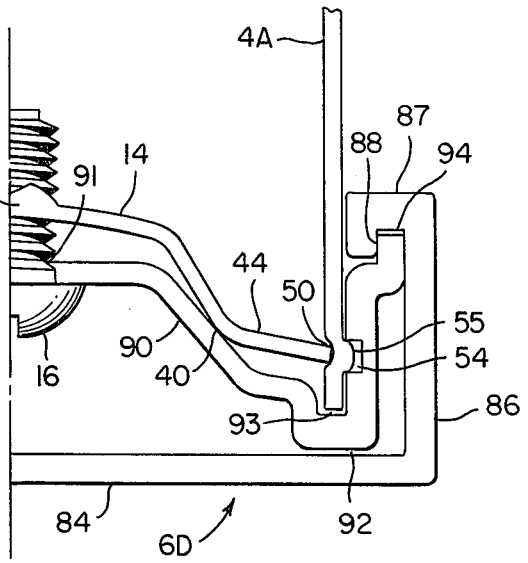
FIG. 7 is a diagrammatic right half top view showing yet another embodiment of the invention whereby the two piece retaining means shown in FIG. 5 and the panels retained thereby are modified for increased retention of the panels in the side caps.

The embodiment of the invention shown in FIG. 7 is in many respects similar to that shown in FIG. 6 except that the side cap and wedge are otherwise modified to enhance the panel retaining characteristics. Thus, in FIG. 7 a U-shaped side cap carrying the numerical designation 6D is shown. Side cap 6D includes a base 84 and an extending side member 86 having a hooked end 87 for forming a groove 88. A wedge 90, which is similar in structure to wedge 76, terminates in an extending end member 92 having a slot 93 for receiving an edge of panel 4A. For purposes of illustration only the right side of the assembly is shown and described. It will be understood that the left side of the assembly is of like configuration.

Wedge 90 has a clearance hole 91 through which round head screw 16 passes so as to be in screw thread engagement with clip 14 as heretofore described with reference to FIG. 6, whereupon turning of the screw spreads the clip so that end 44 abuts panel 4A to retain the panel in slot 93, after which side cap 6D is slided over the clip, wedge and panel assembly, and retained thereon by hook end 87 receiving end 94 of member 92. Again, the features described with reference to FIG. 4 may be incorporated into the invention as shown in FIG. 7, with like elements carrying like numerical designations. Indeed, the features of FIG. 4 may be incorporated into all of the embodiments of the invention described herein as will now be understood.

Figure 8:
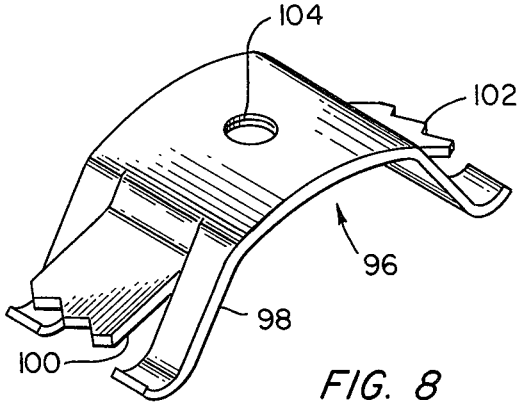
FIG. 8 is an isometric pictorial representation showing a unitary member having the basic retaining characteristics of the two piece retaining means shown in FIGS. 5, 6 and 7.

The embodiments of the invention described with reference to FIGS. 5, 6 and 7 have been illustrated as featuring a two piece retainer including resilient clip 14 and wedges 56, 76 and 90, respectively. FIG. 8 shows an embodiment of the invention wherein the clip and wedge are of a one piece unitary spring like construction such as may be provided by a metallic stamping or the like. Thus, the unitary retainer designated by the numeral 96 in FIG. 8 includes a wedge portion 98 and a resilient clip portion 100. Clip portion 100 extends angularly beyond either side of wedge portion 98 and carries serrations 102 or the like which bite into the panels for increased retention upon wedge portion 98 spreading through the turning of screw 16A in threaded hole 104 as illustrated in FIG. 9.

Figure 9:
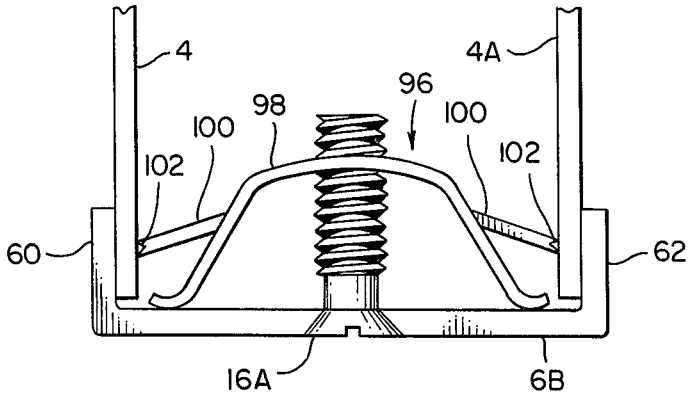
FIG. 9 is a diagrammatic representation showing the unitary member of FIG. 8 in cooperation with a simplified side cap according to the invention.

With reference to FIG. 9, unitary retainer 96 of FIG. 8 is shown in an embodiment of the invention such as essentially illustrated and described with reference to FIG. 5, with like elements carrying like numerical designations.

Figure 10:
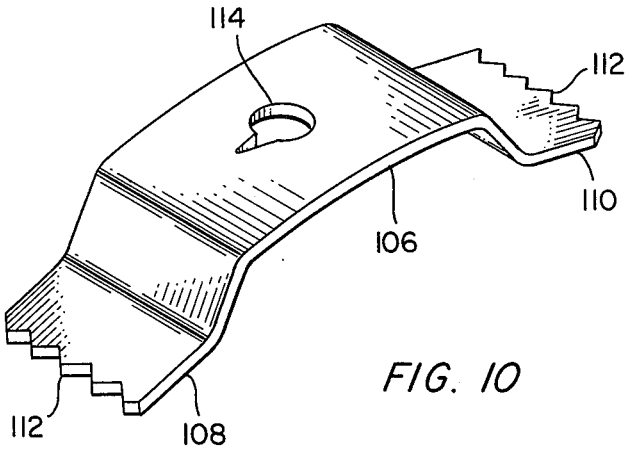
FIG. 10 is an isometric representation showing a one piece retainer with serrated ends for increased panel retention.

FIG. 10 shows a particular form of clip which may be used with embodiments of the invention shown in FIGS. 3, 4, 5, 6 and 7 in place of clip 14 as has been described. Thus, the clip, which is designated by the numeral 106, has extending portions 108 and 110 carrying serrations or the like 112 at the ends thereof which bite into the panels upon the clip being spread by turning of the appropriate screw 16 or 16A, as the case may be, which is in screw thread arrangement with a threaded conical hole 114. Serrations 102 and 112 shown in FIGS. 8 and 10, respectively, may be applied to the other embodiments of the invention as will be understood.

It will now be seen that the aforenoted objects of the invention have been met by the several embodiments herein described. A side cap and means associated therewith for retaining panels arranged in spaced relation to each other is provided. The invention is particularly useful for providing panel assemblies of the type contemplated which are fabricated to a standard size and then trimmed to an installation size. The means of the invention provides a finishing effect upon the panels being so trimmed and serves the further purpose of rigidly retaining the panels in spaced relation and strengthening the assembly as is desired.

Although several embodiments of the invention have been described in detail it is expressly understood that the invention is not limited thereto. Various changes may also be made in the design and arrangement of the elements of the invention without departing from the spirit and scope thereof as the same will now be understood by those skilled in the art.

What is claimed is:

1. For panel assemblies of the type including a pair of panels arranged in spaced relation, combined side cap and panel retaining means comprising:

a pair of longitudinally extending side caps;

corresponding edges of each of the pair of panels disposed within one of the pair of side caps and the opposite corresponding edges of each of the pair of panels disposed within the other of the pair of side caps, said panels thereupon being in the spaced relation;

a plurality of retaining means disposed along the one and the other side caps and supported thereby, each of which retaining means includes a resilient retainer intermediate the corresponding panel edges disposed with said side caps;

a corresponding plurality of operator adjustable means in cooperative relation with the one and the other side caps and the resilient retainers, and adjusted to spread the retainers for abutting the corresponding panel edges disposed within said side caps for retaining the panels in the spaced relation;

the one and the other side caps each include an inwardly extending wedge having end portions terminating in slots and a centrally disposed clearance hole;

the corresponding edges of each of the pair of panels disposed within the one of the pair of side caps being received by the slots in said one side cap, and the opposite corresponding edges of each of the pair of panels disposed within the other of the pair of side caps being received by the slots in said other side cap;

the resilient retainers being supported by the wedge intermediate the corresponding panel edges disposed within the one and the other side caps, said retainers including a centrally disposed threaded hole in substantial alignment with the clearance hole in the wedge; and each of the operator adjustable means includes an adjustable screw extending through the wedge clearance hole and in threaded engagement with the threaded retainer hole, and adjusted to spread the retainer.

2. Combined side cap and retaining means as described by claim 1, wherein:

the resilient retainers have opposite end members which abut the corresponding panel edges when the retainers are spread by adjusting the operator adjustable means;

each of the panels includes a dimple on the inside surface thereof and a corresponding node on the outside surface thereof;

the area of the side cap slot adjacent the outside panel surface includes a recess corresponding to the panel node; and the opposite end members of the retainers are received by the respective panel dimples and the corresponding panel nodes are received by the respective side cap slot recesses.

3. Combined side cap and retaining means as described by claim 1, wherein:

the resilient retainers have opposite end members which abut the corresponding panel edges when the retainers are spread by adjusting the operator adjustable means; and the end members carry serrations for biting into the corresponding panel edges.

4. For panel assemblies of the type including a pair of panels arranged in spaced relation, combined side cap and panel retaining means comprising:

a pair of longitudinally extending side caps;

corresponding edges of each of the pair of panels disposed within one of the pair of side caps and the opposite corresponding edges of each of the pair of panels disposed within the other of the pair of side caps, said panels thereupon being in the spaced relation;

a plurality of retaining means disposed along the one and the other side caps and supported thereby, each of which retaining means includes a resilient retainer intermediate the corresponding panel edges disposed within said side caps;

a corresponding plurality of operator adjustable means in cooperative relation with the one and the other side caps and the resilient retainers, and adjusted to spread the retainers for abutting the corresponding panel edges disposed within said side caps for retaining the panels in the spaced relation;

the one and the other side caps each include a pair of extending side members separated by a base member;

the corresponding edges of each of the pair of panels disposed within the one of the pair of side caps being disposed near the extending side members of said one side cap, and the opposite corresponding edges of each of the pair of panels disposed within the other of the pair of side caps being disposed near the extending side members of said other side cap;

each of the retaining means includes a wedge supported by the base members of the side caps and a centerally disposed clearance hole, and the resilient retainer of the retaining means supported by the wedge, said resilient retainer having a centrally disposed threaded hole in substantial alignment with the clearance hole in the wedge; and each of the operator adjustable means includes an adjustable screw extending through the wedge clearance hole and in threaded engagement with the threaded retainer hole, and adjusted to spread the retainer.

5. Combined side cap and retaining means as described by claim 4, wherein:

the retaining means are unitary members having a wedge portion supported by the side caps and a resilient retainer portion having end members extending beyond the ends of the wedge portion; and the end members carry serrations for biting into the corresponding panel edges.

6. Combined side cap and retaining means as described by claim 4, wherein:

the resilient retainers have opposite end members which abut the corresponding panel edges when the retainers are spread by adjusting the operator adjustable means; and the end members carry serrations for biting into the corresponding panel edges.

7. Combined side cap and retaining means as described by claim 4, wherein:

the retaining means are unitary members having a wedge portion supported by the side caps and a resilient retainer portion having end members extending beyond the ends of the wedge portion; and the end members carry serrations for biting into the corresponding panel edges.

8. Combined side cap and retaining means as described by claim 4, wherein:

the resilient retainers have opposite end members which abut the corresponding panel edges when the retainers are spread by adjusting the operator adjustable means;

each of the panels includes a dimple on the inside surface thereof and a corresponding node on the outside surface thereof;

the area of the extending side member of the side cap near the outside panel surface includes a recess corresponding to the panel node; and the opposite end members of the retainers are received by the respective panel dimples, and the corresponding panel nodes are received by the respective extending side member recesses.

9. For panel assemblies of the type including a pair of panels arranged in spaced relation, combined side cap and panel retaining means comprising:

a pair of longitudinally extending side caps;

corresponding edges of each of the pair of panels disposed within one of the pair of side caps and the opposite corresponding edges of each of the pair of panels disposed within the other of the pair of side caps, said panels thereupon being in the spaced relation;

a plurality of retaining means disposed along the one and the other side caps and supported thereby, each of which retaining means includes a resilient retainer intermediate the corresponding panel edges disposed within said side caps;

a corresponding plurslity of operator adjustable means in cooperative relation with the one and the other side caps and the resilient retainers, and adjusted to spread the retainers for abutting the corresponding panel edges disposed within said side caps for retaining the panels in the spaced relation;

the one and the other side caps each include a pair of extending side members separated by a base member;

each of the retaining means includes a wedge having extending side members forming slots, said slots being in the spaced relation, and a centrally disposed clearance hole;

the corresponding edges of each of the pair of panels disposed within the slots;

the resilient retainers of the retainer means supported by the wedge and having a centrally disposed threaded hole in substantial alignment with the clearance hole in the wedge; each of the operator adjustable means includes an adjustable screw extending through the wedge clearance hole and in threaded engagement with the threaded retainer hole, and adjusted for spreading the retainers to abut the corresponding panel edges disposed within the slots for retaining the panels in the spaced relation; and the side caps being disposed over the wedges, with the wedges supported on the base member of the side caps.

10. Combined side cap and panel retaining means as described by claim 9, wherein:

the pair of extending side members of the one and the other side caps terminate in ledges; and the side caps are snapped on the wedges so as to be disposed thereover, and retained thereon by the ends of the extending side members of the wedges being adjacent the corresponding side member ledges.

11. Combined side cap and panel retaining means as described by claim 9, wherein:

the pair of extending side members of the one and the other side caps terminate in hooked ends; and the side caps are slided on the wedges so as to be disposed thereover, and retained thereon by the ends of the extending side members of the wedges being received by the corresponding side member hooked ends.

12. Combined side cap and retaining means as described by claim 9, wherein:

the resilient retainers have opposite end members which abut the corresponding panel edges when the retainers are spread by adjusting the operator adjustable means;

each of the panels includes a dimple on the inside surface thereof and a corresponding node on the outside surface thereof.

the area of the wedge side member slot adjacent the outside panel surface includes a recess corresponding to the panel node; and the opposite end members of the retainers are received by the respective panel dimples, and the corresponding panel nodes are received by the respective wedge side member recesses.

13. Combined side cap and retaining means as described by claim 9, wherein:

the resilient retainers have opposite end members which abut the corresponding panel edges when the retainers are spread by adjusting the operator adjustable means; and the end members carry serrations for biting into the corresponding panel edges.

* * * * *